US008813698B2

(12) United States Patent
Ezaki et al.

(10) Patent No.: US 8,813,698 B2
(45) Date of Patent: Aug. 26, 2014

(54) VARIABLE VALVE APPARATUS OF INTERNAL COMBUSTION ENGINE

(75) Inventors: Shuichi Ezaki, Susono (JP); Shuuji Nakano, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 215 days.

(21) Appl. No.: 13/057,383

(22) PCT Filed: Mar. 6, 2009

(86) PCT No.: PCT/JP2009/054298

§ 371 (c)(1), (2), (4) Date: Feb. 3, 2011

(87) PCT Pub. No.: WO2010/100753

PCT Pub. Date: Sep. 10, 2010

(65) Prior Publication Data

US 2011/0303174 A1 Dec. 15, 2011

(51) Int. Cl.

| | |
|---|---|
| ***F01L 1/34*** | (2006.01) |
| ***F01L 1/18*** | (2006.01) |
| ***F01M 9/10*** | (2006.01) |
| ***F01L 1/26*** | (2006.01) |
| ***F01L 13/00*** | (2006.01) |
| ***F01L 1/24*** | (2006.01) |

(52) U.S. Cl.

CPC ..... *F01M 9/101* (2013.01); *F01M 9/10* (2013.01); *F01L 1/267* (2013.01); *F01L 1/185* (2013.01); *F01L 2810/02* (2013.01); *F01L 13/0005* (2013.01); *F01L 2820/031* (2013.01); *F01L 1/2411* (2013.01); *F01L 2105/00* (2013.01)

USPC ..... 123/90.16; 123/90.15; 123/90.39; 123/90.44; 123/90.46

(58) Field of Classification Search

USPC ..... 123/90.16, 90.39, 90.44, 90.15, 90.46

See application file for complete search history.

(56) References Cited

U.S. PATENT DOCUMENTS 1,238,175 A * 8/1917 Moore ..... 123/90.26
1,280,912 A * 10/1918 Waterman ..... 74/567

(Continued)

FOREIGN PATENT DOCUMENTS

EP 1752622 B1 * 7/2009 ..... F01L 1/30
GB 2473250 A * 3/2011 ..... F01L 13/00

(Continued)

OTHER PUBLICATIONS

English machine translation of EP 1 752 622 from Espacenet www.epo.org.*

International Search Report mailed May 19, 2009 issued in International Patent Application No. PCT/JP2009/054298 (with translation).

*Primary Examiner* — Kenneth Bomberg
*Assistant Examiner* — Daniel Wagnitz
(74) *Attorney, Agent, or Firm* — Oliff PLC

(57) ABSTRACT

A variable valve apparatus of an internal combustion engine includes a first rocker arm that contacts a cam, a low lift cam provided coaxially with the cam, and a second rocker arm capable of contacting the low lift cam. The apparatus also includes a switching mechanism capable of connecting the first rocker arm and the second rocker arm to each other through pins, valves that open by being pressed by the second rocker arms via hydraulic lash adjusters arranged in the second rocker arms, and an oil supply path formed inside the second rocker arms that supplies oil to the hydraulic lash adjusters. A radius of a base circle of the low lift cam is smaller than a radius of a base circle of the cam.

9 Claims, 9 Drawing Sheets

(56) References Cited

U.S. PATENT DOCUMENTS

| | | | | |
|---|---|---|---|---|
| 4,777,914 | A | 10/1988 | Konno | |
| 4,829,948 | A * | 5/1989 | Yoshida et al. | 123/90.16 |
| 4,856,466 | A * | 8/1989 | Ting et al. | 123/90.33 |
| 6,318,315 | B1 * | 11/2001 | Harada et al. | 123/90.16 |
| 6,343,581 | B2 * | 2/2002 | Suzuki | 123/90.17 |
| 6,470,840 | B1 * | 10/2002 | Ebesu et al. | 123/90.17 |
| 6,644,254 | B2 * | 11/2003 | Harada et al. | 123/90.16 |
| 6,679,210 | B2 * | 1/2004 | Iijima | 123/90.36 |
| 6,854,434 | B2 * | 2/2005 | Methley | 123/90.16 |
| 2004/0168658 | A1 | 9/2004 | Sakai et al. | |
| 2004/0200446 | A1 * | 10/2004 | Methley | 123/90.16 |
| 2010/0132644 | A1 * | 6/2010 | Methley et al. | 123/90.44 |

FOREIGN PATENT DOCUMENTS

| | | | | |
|---|---|---|---|---|
| JP | U-61-48905 | | 4/1986 | |
| JP | A-63-97808 | | 4/1988 | |
| JP | U-63-151906 | | 10/1988 | |
| JP | A-64-3212 | | 1/1989 | |
| JP | A-5-33618 | | 2/1993 | |
| JP | A-11-287139 | | 10/1999 | |
| JP | A-2003-106179 | | 4/2003 | |
| JP | A-2006-57535 | | 3/2006 | |
| WO | WO 2008/139221 | A1 * | 11/2008 | F01L 13/00 |

* cited by examiner

VARIABLE VALVE APPARATUS OF INTERNAL COMBUSTION ENGINE

TECHNICAL FIELD

The present invention relates to a variable valve apparatus of an internal combustion engine.

BACKGROUND ART

Japanese Patent Laid-Open No. 11-287139 discloses a variable valve apparatus that varies valve-opening characteristics of an intake valve or an exhaust valve. The aforementioned variable valve apparatus includes a plurality of rocker arms that are driven by a plurality of cams that have different lifts, and a switching mechanism that switches between a state that connects the rocker arms through a pin (connecting piston) and a state that releases the connection.

Japanese Utility Model Laid-Open No. 61-48905 discloses a valve mechanism in which a hydraulic lash adjuster is arranged in a rocker arm, and the hydraulic lash adjuster contacts against a valve stem. According to this valve mechanism, an oil supply path for supplying oil to the hydraulic lash adjuster is formed inside the rocker arm. Oil in an oil path formed within a rocker shaft that supports the rocker arm is supplied to the hydraulic lash adjuster through the aforementioned oil supply path.

Patent Document 1: Japanese Patent Laid-Open No. 11-287139

Patent Document 2: Japanese Utility Model Laid-Open No. 61-48905

Patent Document 3: Japanese Patent Laid-Open No. 2006-57535

DISCLOSURE OF THE INVENTION

Problems to be Solved by the Invention

According to the variable valve apparatus disclosed in Japanese Patent Laid-Open No. 11-287139, a roller for reducing frictional resistance with a cam, and a pin of the switching mechanism are arranged in a center part of a rocker arm. If a case is assumed in which a hydraulic lash adjuster is arranged in this kind of rocker arm, the necessity sometimes arises to lengthen the rocker arm and raise the position of the camshaft in order to secure installation space for the hydraulic lash adjuster itself and installation space for an oil supply path for supplying a hydraulic pressure. As a result, not only will the size of the overall valve mechanism system increase, but a moment of inertia of the rocker arm will also increase. Hence, the equivalent inertia mass of the valve mechanism system will increase, the necessity will arise to increase the valve spring load, and friction will increase.

The present invention has been made in view of the above described points, and an object of the invention is to provide a variable valve apparatus of an internal combustion engine in which a hydraulic lash adjuster is arranged in a rocker arm, and which can reduce the size of a rocker arm and decrease friction.

Solution to Problem

A first invention for achieving the above object is a variable valve apparatus of an internal combustion engine, comprising:

a cam provided on a camshaft that rotates;

a first rocker arm that contacts the cam, and that is rocked by rotation of the cam;

a low lift cam that is arranged coaxially with the cam and has a lift that is less than a lift of the cam or that is zero, and that has a base circle radius that is less than a base circle radius of the cam;

a second rocker arm that is arranged next to the first rocker arm and that can contact the low lift cam;

a switching mechanism that has a pin insertion hole formed in the first rocker arm and the second rocker arm as well as a pin that is inserted into the pin insertion hole, and which can switch between a connected state in which the first rocker arm and the second rocker arm are connected to each other through the pin and a non-connected state in which the connection of the first rocker arm and the second rocker arm is released;

a hydraulic lash adjuster arranged at an end on an opposite side to a rocking center of the second rocker arm;

a valve that opens as a result of being pressed by the second rocker arm via the hydraulic lash adjuster; and an oil supply path that is formed inside the second rocker arm and that supplies oil to the hydraulic lash adjuster.

A second invention is in accordance with the first invention, wherein:

the switching mechanism has a pin moving mechanism that displaces the pin between a position of the connected state and a position of the non-connected state; and the pin moving mechanism displaces the pin by means of a force other than a hydraulic pressure.

A third invention is in accordance with the first or second invention, wherein:

the first rocker arm has a roller at an area that contacts the cam; and the second rocker arm contacts the low lift cam directly, and not via a roller.

A fourth invention is in accordance with the third invention, wherein the pin is provided concentrically with the roller included in the first rocker arm.

A fifth invention is in accordance with the third or fourth invention, wherein the oil supply path passes between a contact surface of the second rocker arm with respect to the low lift cam and the pin insertion hole formed in the second rocker arm.

A sixth invention is in accordance with any one of the third to fifth inventions, wherein the second rocker arm has: a lubricating oil supply path that supplies oil in the oil supply path to a contact portion between the second rocker arm and the low lift cam; and an oil-supply stop valve that seals off the lubricating oil supply path when the second rocker arm rocks.

A seventh invention is in accordance with any one of the third to sixth inventions, wherein a contact surface of the second rocker arm with respect to the low lift cam is a recessed curved surface with a curvature radius that is greater than the base circle radius of the low lift cam.

An eighth invention is in accordance with any one of the first to seventh inventions, wherein a lift of the low lift cam is zero, and the low lift cam is mounted via a rolling bearing on the camshaft.

An ninth invention is in accordance with any one of the first to eighth inventions, further comprising:

a pair of the low lift cams that are arranged at both sides of the cam; and a pair of the second rocker arms that are arranged at both sides of the first rocker arm.

An tenth invention is in accordance with any one of the first to ninth inventions, wherein the oil supply path formed inside the second rocker arm is formed in a straight line shape.

Advantages of the Invention

According to the first invention, by arranging a hydraulic lash adjuster in a second rocker arm, a valve clearance can be independently absorbed for each valve. Further, by making a radius of the base circle of a low lift cam that contacts with the second rocker arm smaller than a radius of the base circle of a cam that contacts with a first rocker arm, it is possible to bring the mounting position of the hydraulic lash adjuster close to the rocking center. Therefore, since an increase in a moment of inertia of the second rocker arm can be suppressed, it is possible to suppress an increase in an equivalent inertia mass of the valve mechanism system and reduce friction. Further, by making the radius of the base circle of the low lift cam smaller than the radius of the base circle of the cam, a distance between the pin of the second rocker arm and the base circle of the low lift cam necessarily increases. Accordingly, it is possible to secure a large space for forming an oil supply path (oil supply path to the hydraulic lash adjuster) between the pin of the second rocker arm and the base circle of the low lift cam. Consequently, the oil supply path can be formed with ease.

According to the second invention, since a pin moving mechanism of a switching mechanism displaces a pin using a force other than a hydraulic pressure, it is not necessary to supply a hydraulic pressure to the pin moving mechanism. In contrast, when a configuration is adopted in which a pin is moved by means of a hydraulic pressure, it is necessary to supply a high hydraulic pressure that is capable of moving the pin to the second rocker arm. When this type of high hydraulic pressure is supplied to a hydraulic lash adjuster, a "pump-up" action is liable to arise in which the hydraulic lash adjuster expands more than required and the valve does not close completely. In contrast, according to the second invention, since the pin moving mechanism does not require a hydraulic pressure, the size of a hydraulic pressure supplied to the second rocker arm can be made a suitable size for the hydraulic lash adjuster. Therefore, the occurrence of a "pump-up" action can be reliably prevented.

According to the third invention, by omitting the roller of the second rocker arm, sufficient space can be secured inside the second rocker arm. Consequently, the oil supply path can be formed with particular ease.

According to the fourth invention, by providing a pin of the switching mechanism concentrically with respect to the roller included in the first rocker arm, it is possible to utilize space effectively and decrease the size of the first rocker arm.

According to the fifth invention, by forming an oil supply path between a contact surface of the second rocker arm with respect to the low lift cam and a pin insertion hole formed in the second rocker arm, it is possible to adequately secure a space for forming the oil supply path. Consequently, the oil supply path can be formed with particular ease.

According to the sixth invention, since oil can be supplied directly to a contact portion between the second rocker arm and the low lift cam, sliding resistance can be reliably decreased. Further, by providing an oil-supply stop valve that automatically stops the supply of oil when the second rocker arm rocks, the oil flow rate can be decreased.

According to the seventh invention, a wedge-shaped gap is formed between the low lift cam and the contact surface of the second rocker arm. Lubrication between the low lift cam and the contact surface of the second rocker arm can be favorably performed by oil that enters into the gap.

According to the eighth invention, by mounting a low lift cam (zero lift cam) which has a lift of zero via a rolling bearing on the camshaft, when the second rocker arm is contacting the zero lift cam (when the valve is closed), rotation of the zero lift cam stops and the camshaft idles with respect to the zero lift cam. More specifically, since the zero lift cam does not slide with respect to the second rocker arm, friction can be adequately reduced.

According to the ninth invention, the invention can be preferably applied to a variable valve apparatus that drives two intake valves or exhaust valves per cylinder.

According to the tenth invention, since the oil supply path in the second rocker arm is formed in a straight line shape, the oil supply path can be manufactured extreme easily.

REFERENCE SIGNS LIST

Figure 1:
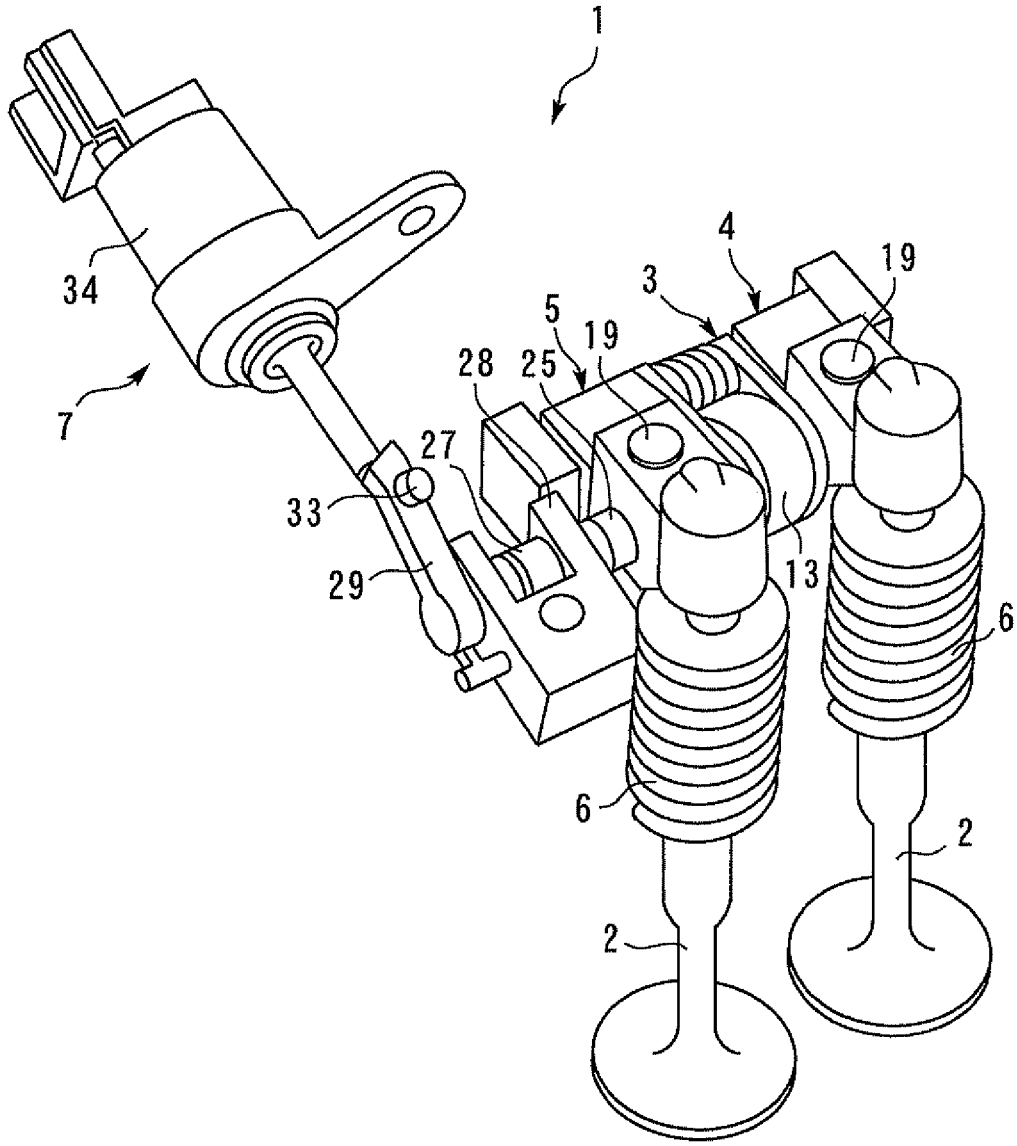
FIG. 1 is an oblique perspective view that illustrates a variable valve apparatus of an internal combustion engine of Embodiment 1 of the present invention.

1 variable valve apparatus
2 valve
3 first rocker arm
4, 5 second rocker arm
7 switching mechanism
8 camshaft
9 cam
10 side plate
11 base plate
12, 21, 26 sleeve
13 roller
14 rocker shaft
17 zero lift cam
18 hydraulic lash adjuster
19 pad
20, 22, 25 pin

23, 24 oil supply path
27 pin pressing member
29 arm
30 guide rail
32 coil spring
33 engagement protrusion
34 electromagnetic solenoid
35 stay
39, 40 stay pin
41, 42 oil supply path
50 second rocker arm
51 contact surface
53 lubricating oil supply path
54 oil-supply stop valve
55 ball
56, 57 inclined surface
60 zero lift cam
61 needle roller
64 hole
90 zero lift cam
91 second rocker arm
92 roller
93 hydraulic lash adjuster

BEST MODE FOR CARRYING OUT THE INVENTION

Hereunder, embodiments of the present invention are described with reference to the drawings. Note that common elements in the drawings are denoted by like reference numerals, and duplicate descriptions of those elements are omitted.

Embodiment 1

FIG. 1 is an oblique perspective view that illustrates a variable valve apparatus of an internal combustion engine of Embodiment 1 of the present invention. An illustration of a camshaft 8 that is described later is omitted from FIG. 1.

A variable valve apparatus of an internal combustion engine (hereunder, referred to simply as "variable valve apparatus") 1 shown in FIG. 1 includes two valves 2. These valves 2 are two intake valves or exhaust valves included in a single cylinder of an internal combustion engine (omitted from the drawings). Although the following description describes the configuration of a portion corresponding to a single cylinder, naturally the present invention can also be applied to a multi-cylinder internal combustion engine.

The variable valve apparatus 1 includes a first rocker arm 3 and a pair of second rocker arms 4 and 5. The pair of second rocker arms 4 and 5 are arranged on two sides in a condition in which the first rocker arm 3 is sandwiched therebetween. The first rocker arm 3 and the second rocker arms 4 and 5 can each rock in a manner that takes a common straight line parallel to the camshaft 8 as a center.

The second rocker arms 4 and 5 are provided at positions corresponding to the two valves 2. Each valve 2 is urged in a closing direction (upward direction in FIG. 1) by a valve spring 6. When the second rocker arms 4 and 5 rock in a downward direction in FIG. 1 and press an end of a stem of the valves 2, respectively, each valve 2 opens.

The variable valve apparatus 1 includes a switching mechanism 7 for switching between a state that connects the first rocker arm 3 and the second rocker arms 4 and 5 and a state in which the connection is released. The switching mechanism 7 is described in detail later.

Figure 2:
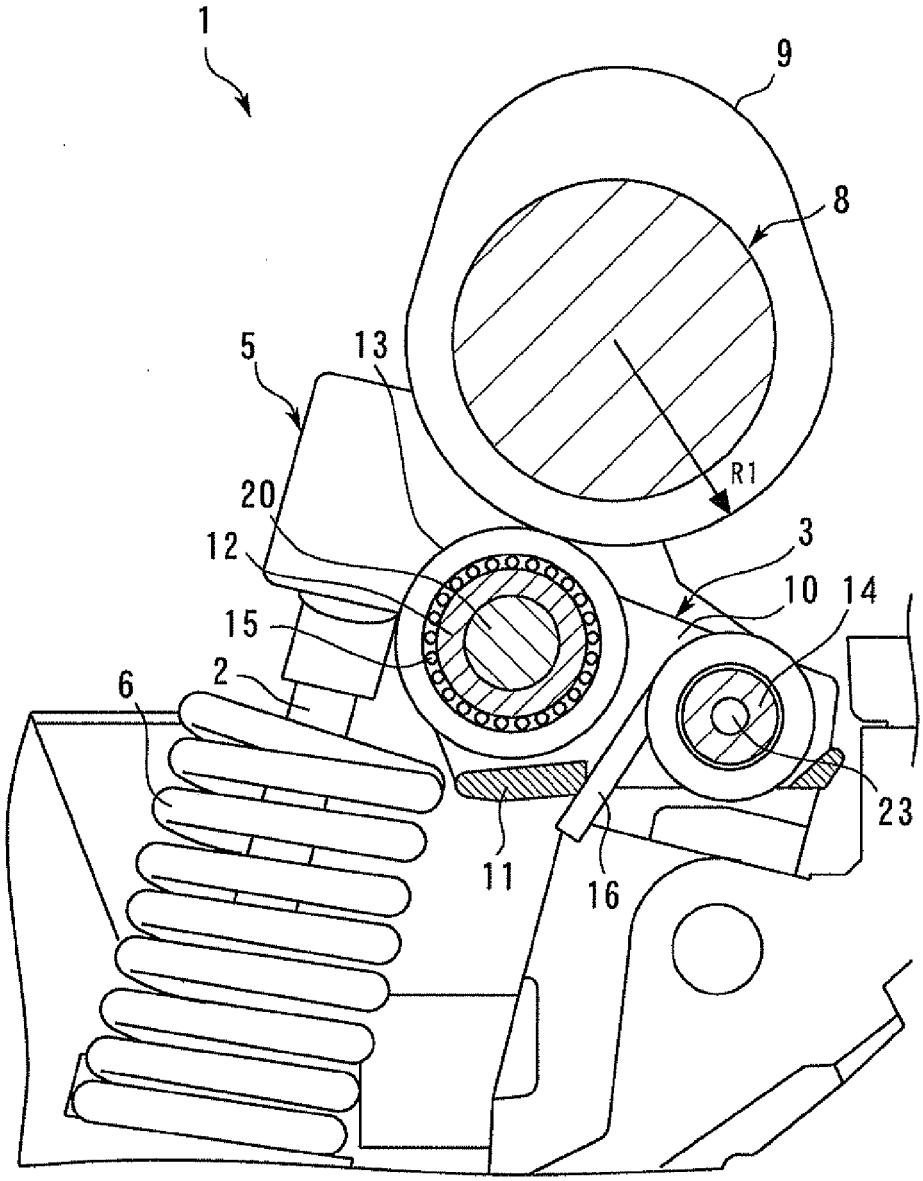
FIG. 2 is a cross-sectional view of the variable valve apparatus of Embodiment 1 of the present invention cut at the position of a first rocker arm.

FIG. 2 is a cross-sectional view of the variable valve apparatus 1 cut at the position of the first rocker arm 3. As shown in FIG. 2, the variable valve apparatus 1 has the camshaft 8. The camshaft 8 is connected to a crankshaft (not shown in the drawings) of the internal combustion engine through a timing chain and the like, and rotates at half the speed of the crankshaft. The camshaft 8 has a cam 9. The cam 9 may be formed as an integral member of the camshaft 8, or may be formed by fixing a separate member to the camshaft 8. Reference character R1 in FIG. 2 denotes a radius of the base circle of the cam 9.

The first rocker arm 3 has a pair of side plates 10 that constitute side faces, a base plate 11 that connects the pair of side plates 10, a cylindrical sleeve 12, and a roller 13 that contacts the cam 9. A hole is formed in each of the pair of side plates 10, and a rocker shaft 14 is inserted through the holes. The first rocker arm 3 is configured to be able to rock around the rocker shaft 14. As described later, the second rocker ars 4 and 5 are also rockably supported by the same rocker shaft 14.

The sleeve 12 is provided at an orientation that is parallel to the camshaft 8 and the rocker shaft 14. The two ends of the sleeve 12 are fixed to the pair of side plates 10, respectively. A hole (pin insertion hole) that penetrates through the first rocker arm 3 in a parallel direction to the rocker shaft 14 is formed by a hollow portion of the sleeve 12.

The roller 13 is provided in a concentric manner on an outer circumferential side of the sleeve 12. A needle roller 15 is provided between the outer circumferential face of the sleeve 12 and the inner circumferential face of the roller 13. Thus, the roller 13 is capable of rotating smoothly.

A torsion coil spring 16 is arranged between the pair of side plates 10. The rocker shaft 14 is inserted through a hollow portion of the torsion coil spring 16. The first rocker arm 3 is urged in a clockwise direction in FIG. 2 by the torsion coil spring 16. As a result, the roller 13 is pressed against the cam 9. Accordingly, when the cam 9 rotates, the first rocker arm 3 rocks as a result of the roller 13 being driven by the cam 9.

A columnar pin 20 included in the switching mechanism 7 is inserted into a hollow portion of the sleeve 12. More specifically, the roller 13 and the pin 20 are arranged concentrically. The pin 20 is movable in an axial direction.

Figure 3:
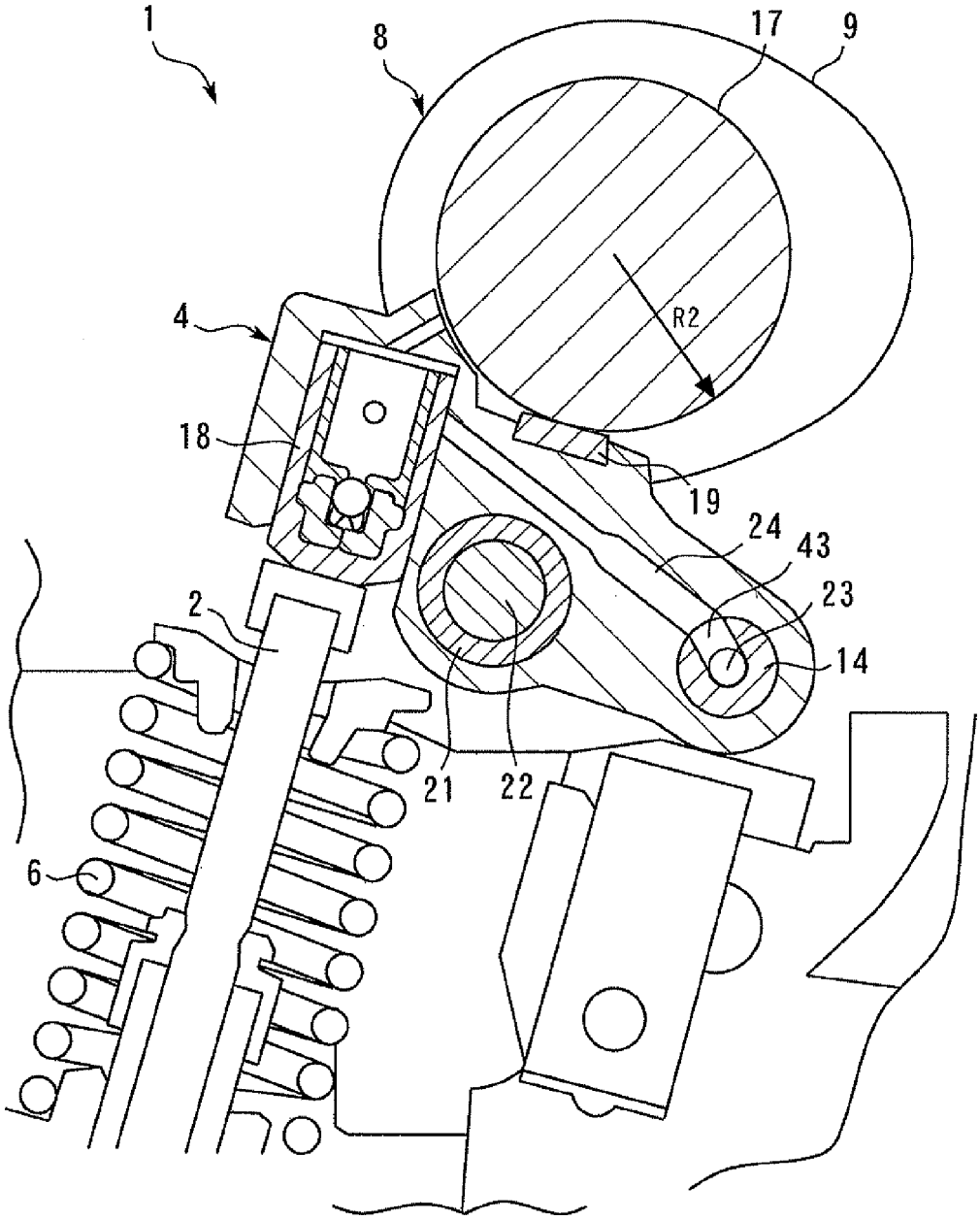
FIG. 3 is a cross-sectional view of the variable valve apparatus of Embodiment 1 of the present invention cut at the position of a second rocker arm.

FIG. 3 is a cross-sectional view of the variable valve apparatus 1 cut at the position of the second rocker arm 4. Since the second rocker arm 4 and the second rocker arm 5 have approximately the same structure, hereunder elements that are common to the second rocker arm 4 and the second rocker arm 5 are denoted by like reference numerals, and duplicate descriptions of those elements are omitted.

In FIG. 3, a zero lift cam 17 that is capable of contacting the second rocker arm 4 is provided on a front side of the cam 9 of the camshaft 8. The zero lift cam 17 has a cylindrical shape, and although in a narrow sense the zero lift cam 17 is not a cam, since the zero lift cam 17 can also be thought of as a cam whose lift is zero, according to the present embodiment the term "zero lift cam" is used therefor.

The zero lift cam 17 may be formed as an integral member of the camshaft 8, or may be formed by fixing a separate member to the camshaft 8. Reference character R2 in FIG. 3 denotes a radius of a base circle of the zero lift cam 17. As described above, since the lift of the zero lift cam 17 is zero, the external shape of the zero lift cam 17 is the base circle itself.

In this connection, although not illustrated in FIG. 3, a similar zero lift cam 17 that is capable of contacting the other second rocker arm 5 is provided at the interior side of the cam 9 in FIG. 3.

A hole is formed in an end on a right side in FIG. 3 of the second rocker arm 4, and the rocker shaft 14 is inserted through the hole. Thus, the second rocker arm 4 is capable of rocking around the rocker shaft 14.

A hydraulic lash adjuster 18 is arranged at an end on an opposite side to the rocking center (rocker shaft 14) of the second rocker arm 4. The hydraulic lash adjuster 18 contacts against the end of the stem of the valve 2.

According to the variable valve apparatus 1, a valve clearance can be maintained at zero by providing the aforementioned hydraulic lash adjuster 18. More specifically, when a gap attempts to develop between the zero lift cam 17 and the second rocker arm 4 or between the stem of the valve 2 and the second rocker arm 4 (hydraulic lash adjuster 18) when the valve 2 is closed, the gap is maintained at zero by the hydraulic lash adjuster 18 extending. Consequently, the zero lift cam 17 and the second rocker arm 4 continuously contact each other when the valve 2 is closed. In this case, since the zero lift cam 17 is rotating, the outer circumferential face of the zero lift cam 17 slides with respect to the second rocker arm 4.

Preferably, aluminum alloy or the like is used as the material of the main body of the second rocker arm 4. The second rocker arm 4 of the present embodiment has a pad 19 made of a different material that has excellent resistance to abrasion at a position at which the second rocker arm 4 contacts the zero lift cam 17. However, the present invention is not limited to this configuration, and a contact surface (sliding surface) with respect to the zero lift cam 17 may be formed on the main body itself of the second rocker arm 4.

The second rocker arm 4 has a cylindrical sleeve 21 that is provided at an orientation that is parallel to the camshaft 8 and the rocker shaft 14. According to the configuration shown in the drawings, the sleeve 21 is inserted into and fixed in a hole formed in the main body of the second rocker arm 4. A columnar pin 22 that the switching mechanism 7 includes is inserted into a hollow portion of the sleeve 21. The pin 22 is movable in the axial direction.

An oil supply path 23 is formed inside the rocker shaft 14. Further, an oil supply path 24 that links the oil supply path 23 inside the rocker shaft 14 and the hydraulic lash adjuster 18 is formed inside the second rocker arm 4. Oil in the oil supply path 23 is fed to the hydraulic lash adjuster 18 via the oil supply path 24. The oil supply path 24 is formed so as to pass between the pad 19 and the sleeve 21.

Figure 4:
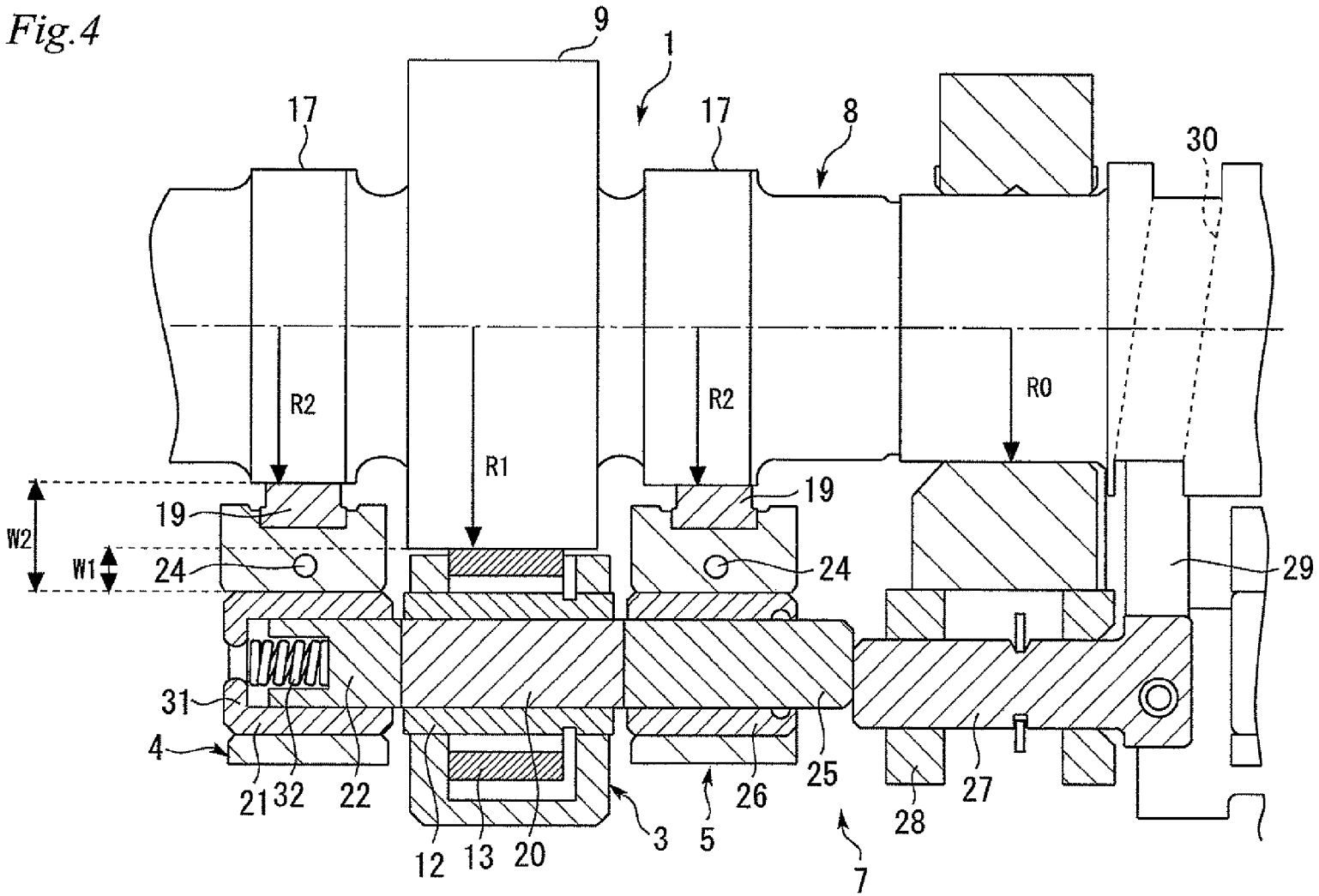
FIG. 4 is a cross-sectional view of the first rocker arm and second rocker arms along a plane including the center of pins that a switching mechanism includes.

Next, the switching mechanism 7 is described. FIG. 4 is a cross-sectional view of the first rocker arm 3 and second rocker arms 4 and 5 along a plane including the center of pins 20, 22, and 25 that the switching mechanism 7 includes. In this connection, FIG. 4 shows a state (hereunder, referred to as "non-connected state") in which a connection between the first rocker arm 3 and the second rocker arms 4 and 5 has been released.

As shown in FIG. 4, a cylindrical sleeve 26 is provided in the second rocker arm 5. A hole (pin insertion hole) that penetrates the second rocker aim 5 in a direction parallel to the camshaft 8 and the rocker shaft 14 is formed by a hollow portion of the sleeve 26. A columnar pin 25 is inserted into the hollow portion of the sleeve 26. The pin 25 is movable in the axial direction. The pin 25 protrudes in the direction of the opposite side to the first rocker arm 3 (right direction in FIG. 4). An end of the protruding pin 25 contacts against an end of a pin pressing member 27 that is formed in a columnar shape. The pin pressing member 27 is inserted into a hole formed in a supporting portion 28 and is rotatable within the hole, and is also movable in a direction parallel to the camshaft 8.

An arm 29 protrudes in a direction perpendicular to the pin pressing member 27 from another end of the pin pressing member 27. The arm 29 can rotate around the pin pressing member 27. A helical guide rail 30 is formed in the camshaft 8 at a portion facing the arm 29.

A base part 31 is formed at an end on an opposite side to the first rocker arm 3 side of the sleeve 21 that is provided in the second rocker arm 4. The pin 22 that is inserted into the sleeve 21 has a concave portion at an end face on a side facing the base part 31. A coil spring 32 is disposed inside the concave portion. The coil spring 32 contacts against the base part 31. The pin 22 is urged in the rightward direction in FIG. 4 by the coil spring 32. As a result of the urging force, the pin 22 contacts against the pin 20, the pin 20 contacts against the pin 25, and the pin 25 contacts against the pin pressing member 27.

In the state illustrated in FIG. 4, the pin 20 and the pin 22 contact against each other in a gap between the first rocker arm 3 and the second rocker arm 4, and the pin 20 and the pin 25 contact against each other in a gap between the first rocker arm 3 and the second rocker arm 5. In this state, the first rocker arm 3 and the second rocker arms 4 and 5 are not connected. Hence, rocking of the first rocker arm 3 that is driven by the cam 9 is not transmitted to the second rocker arms 4 and 5. Accordingly, even when the cam 9 (camshaft 8) rotates, the second rocker arms 4 and 5 maintain a state of contact with the zero lift cam 17, and hence the valves 2 do not open. Thus, when the first rocker arm 3 and the second rocker arms 4 and 5 are in a non-connected state, the valves 2 are stopped in a closed state.

The outer diameters of the pins 20, 22, and 25 are equal to each other, and the distances from the rocker shaft 14 to the pins 20, 22, and 25 are also equal to each other. Thus, in a non-connected state, when a base circle portion of the cam 9 is contacting the roller 13, the centers of the pins 20, 22 and 25 match. If pressing of the pin 25 by the pin pressing member 27 is released, when the centers of the pins 20, 22, and 25 are matching, the pins 20, 22, and 25 move together in the rightward direction in FIG. 4 under the urging force of the coil spring 32. Thereupon, one portion of the pin 20 enters the sleeve 26 of the second rocker arm 5, and one portion of the pin 22 enters the sleeve 12 of the first rocker arm 3. As a result, the first rocker arm 3 and the second rocker arm 5 are connected through the pin 20, and the first rocker arm 3 and the second rocker arm 4 are connected through the pin 22. Hereunder, this state is referred to as a "connected state". When the first rocker arm 3 and the second rocker arms 4 and 5 are in a connected state, the second rocker arms 4 and 5 rock in an integrated manner with the first rocker arm 3. Accordingly, since the second rocker arms 4 and 5 press the respective valves 2 and cause the valves 2 to open, both of the valves 2 perform opening/closing operations.

The pin pressing member 27 is driven by the camshaft 8 via the arm 29. As shown in FIG. 1, an engagement protrusion 33 that can engage with the guide rail 30 formed in the camshaft 8 is formed in the arm 29. The arm 29 is urged by an unshown spring in a direction in which the arm 29 rotates so that the engagement protrusion 33 moves away from the camshaft 8. An electromagnetic solenoid 34 is arranged at a position at which a distal end of the arm 29 can be pressed towards the camshaft 8.

When switching from the connected state of the first rocker arm 3 and second rocker arms 4 and 5 to the non-connected state as described above, the electromagnetic solenoid 34 is placed in an operating state. When the electromagnetic solenoid 34 operates to press the arm 29, the engagement protrusion 33 is pressed against the camshaft 8. When the position of the engagement protrusion 33 matches the starting edge of the guide rail 30, the engagement protrusion 33 engages with the guide rail 30. When the camshaft 8 rotates in that state, the engagement protrusion 33 moves along the guide rail 30 and causes the arm 29 to move in a direction approaching the second rocker arm 5. As a result, since the pin pressing member 27 presses the pin 25, the coil spring 32 contracts and the pins 20, 22, and 25 move to the positions shown in FIG. 4. Thus, the connection between the first rocker arm 3 and the second rocker arms 4 and 5 is released and the first rocker arm 3 and the second rocker arms 4 and 5 enter the non-connected state.

In contrast, when switching from the non-connected state of the first rocker arm 3 and the second rocker arms 4 and 5 to the connected state, the electromagnetic solenoid 34 is placed in a non-operating state. When the electromagnetic solenoid 34 does not operate and pressing of the arm 29 is released, the arm 29 is rotated in a direction away from the camshaft 8 by an urging force of an unshown spring. As a result, the engagement protrusion 33 moves away from the camshaft 8. Thus, the pressing of the pin 25 by the pin pressing member 27 is released. Thereupon, as described above, the pins 20, 22 and 25 are moved in the rightward direction in FIG. 4 by an urging force of the coil spring 32. As a result, one portion of the pin 20 enters the sleeve 26 of the second rocker arm 5 and one portion of the pin 22 enters the sleeve 12 of the first rocker arm 3, and thereby the first rocker arm 3 and the second rocker arms 4 and 5 are connected.

According to the variable valve apparatus 1, by switching between the connected state and the non-connected state of the first rocker arm 3 and the second rocker arms 4 and 5 by means of the switching mechanism 7 as described above, it is possible to switch between a normal state in which the valves 2 are caused to perform opening/closing operations and a valve stopped state in which opening/closing operations of the valves 2 are stopped.

Figure 5:
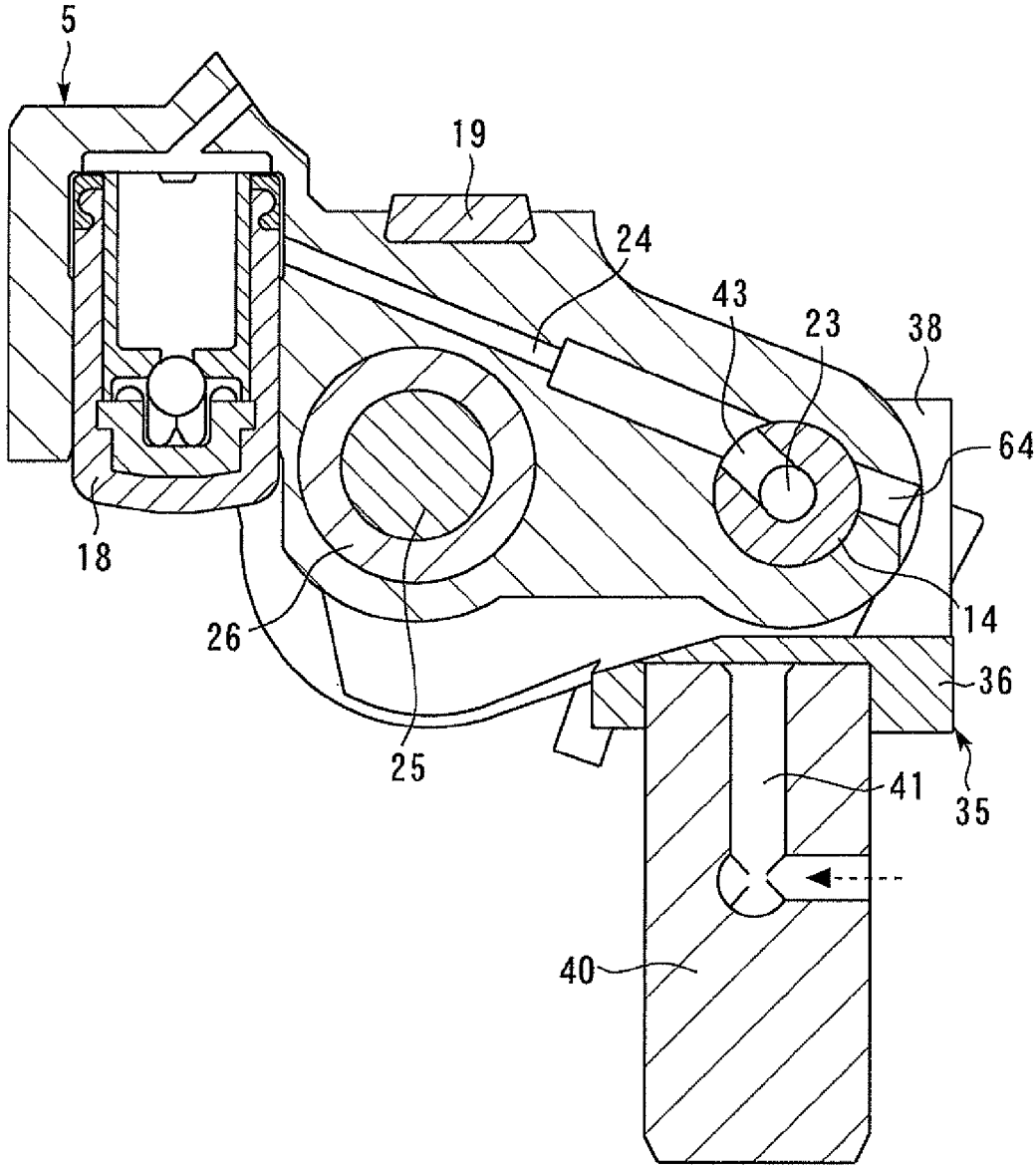
FIG. 5 is a cross-sectional side view of the variable valve apparatus of Embodiment 1 of the present invention cut at the position of the second rocker arm.
Figure 6:
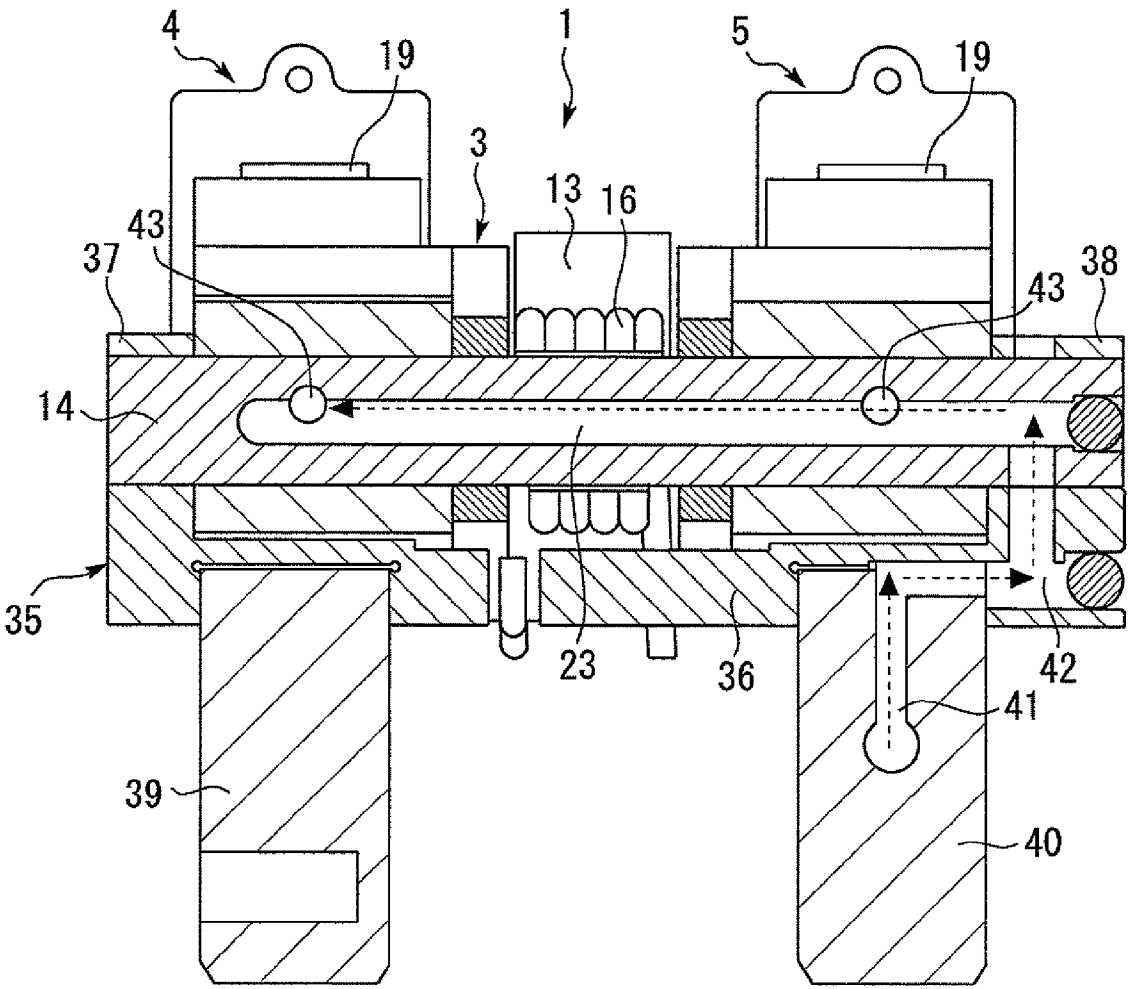
FIG. 6 is a cross-sectional view of the variable valve apparatus of Embodiment 1 of the present invention cut along a plane including the center of a rocker shaft.

Next, a hydraulic-pressure supply path that supplies a hydraulic pressure to the hydraulic lash adjuster 18 is further described. FIG. 5 is a cross-sectional side view of the variable valve apparatus 1 cut at the position of the second rocker arm 5. FIG. 6 is a cross-sectional view of the variable valve apparatus 1 cut along a plane including the center of the rocker shaft 14. As shown in FIG. 6, the rocker shaft 14 is supported by a stay 35. The stay 35 has a base part 36, and supporting portions 37 and 38 that are vertically arranged at two ends of the base part 36, respectively. Holes into which the ends of the rocker shaft 14 are inserted are formed in the supporting portions 37 and 38, respectively. With the two ends of the rocker shaft 14 inserted into the holes, the rocker shaft 14 is fixed in the stay 35.

The stay 35 is fixed to a cylinder head (not shown in the drawings) of the internal combustion engine through stay pins 39 and 40. An oil supply path 41 is formed inside the stay pin 40. As shown in FIG. 5, first, oil is fed from an oil supply path in the cylinder head to the oil supply path 41 inside the stay pin 40. As shown in FIG. 6, the oil passes through an oil supply path 42 formed inside the supporting portion 38 of the stay 35 from the oil supply path 41 in the stay pin 40, and is supplied to the oil supply path 23 in the rocker shaft 14. A hole 43 that opens towards the oil supply path 24 formed in the second rocker arms 4 and 5 is formed in the rocker shaft 14 at a portion that is hidden on the inner side of the second rocker arms 4 and 5. As shown in FIG. 5, oil in the oil supply path 23 inside the rocker shaft 14 passes through the hole 43 and flows into the oil supply path 24 inside the second rocker arms 4 and 5. The oil then passes through the oil supply path 24 and is supplied to the hydraulic lash adjuster 18.

According to the present embodiment, as shown in FIG. 5, the oil supply path 24 is formed in a straight line shape. A hole 64 is formed on an extension of the oil supply path 24 at a back end of the second rocker arm 5. When manufacturing the second rocker arm 5, the oil supply path 24 can be easily formed by inserting a drill from the hole 64.

As described above, according to the variable valve apparatus 1 of the present invention, the hydraulic lash adjusters 18 are arranged in the second rocker arms 4 and 5, respectively, and the second rocker arms 4 and 5 press the valves 2 via the hydraulic lash adjusters 18, respectively. Further, the rocker shaft 14 is fixed to the cylinder head directly, and not via a hydraulic lash adjuster.

In contrast, a configuration that is different to the present invention may be considered in which a hydraulic lash adjuster is not arranged in the second rocker arm, and both ends of a rocker shaft are supported via a hydraulic lash adjuster, respectively. However, there is the following disadvantage when such a configuration is adopted. According to this configuration, since two hydraulic lash adjusters are connected via a rocker shaft, it is necessary for extension amounts of the two hydraulic lash adjusters to be equal. More specifically, since the extensions of the hydraulic lash adjusters are regulated in accordance with the valve that has the smaller valve clearance between the two valves, a valve clearance at the other valve is not completely absorbed, and consequently a valve clearance arises. There is thus the problem that a noise or impact occurs when the valve at which the valve clearance arises is pressed by the second rocker arm and opens. It is necessary to provide a ramp portion in the cam in order to alleviate the noise or impact, and opening of the valve with the smaller valve clearance is started by the ramp portion before the other valve starts to open. Consequently, the actual working angles of the two valves are not the same, and there is a risk that this will adversely affect output performance, fuel consumption performance, emissions, and the like of the internal combustion engine.

In contrast, according to the variable valve apparatus 1 of the present embodiment, by arranging the hydraulic lash adjuster 18 in each of the second rocker arms 4 and 5, the valve clearances of the two valves 2 can be independently absorbed. It is therefore possible to reliably prevent the occurrence of the disadvantage described above.

However, when the hydraulic lash adjusters 18 are provided in the second rocker arms 4 and 5, the second rocker arms 4 and 5 are liable to increase in size and the equivalent inertia mass of the valve mechanism system is liable to increase. As a result, adverse effects are liable to arise such as an increase in the overall size of the variable valve apparatus 1, a necessity to increase the spring load of the valve spring 6 or the like, and an increase in friction.

Figure 7:
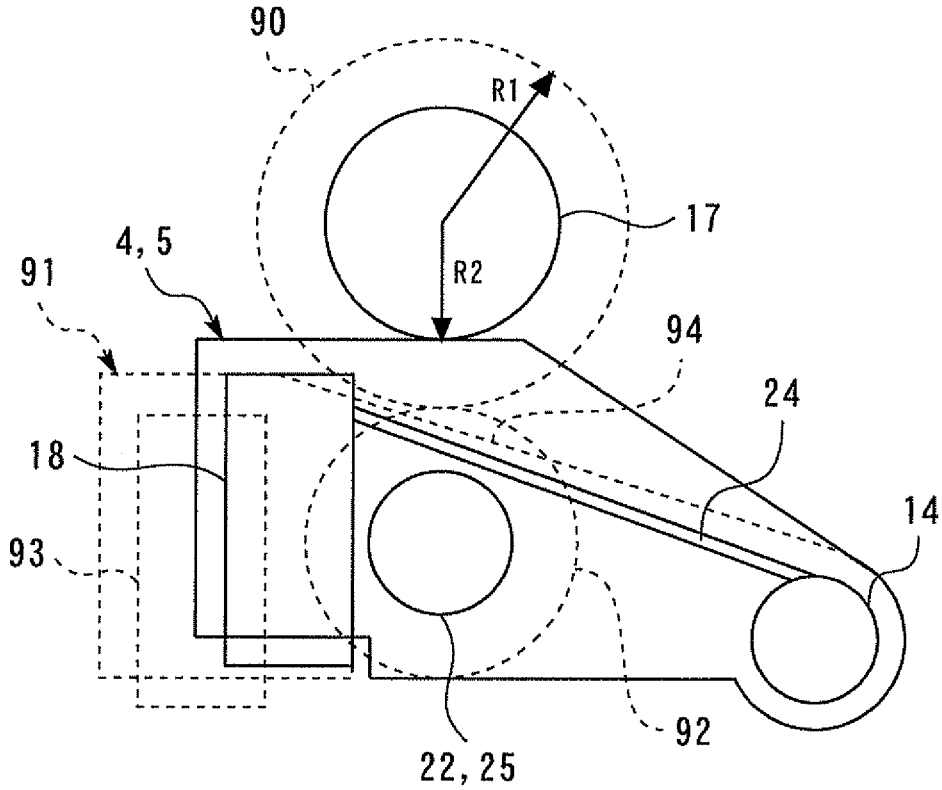
FIG. 7 is a view that schematically illustrates the variable valve apparatus of Embodiment 1 of the present invention and a variable valve apparatus according to a comparative example.

In contrast, according to the variable valve apparatus 1 of the present embodiment, the aforementioned adverse effects can be adequately suppressed by making the radius R2 of the base circle of the zero lift cam 17 smaller than the radius R1 of the base circle of the cam 9. This advantage will now be described referring to FIG. 7. FIG. 7 is a view that schematically illustrates the variable valve apparatus 1 of the present embodiment and a variable valve apparatus according to a comparative example. In FIG. 7, the variable valve apparatus 1 of the present embodiment and the variable valve apparatus of the comparative example are represented in a superimposed manner based on the assumption that the respective center positions of the camshaft 8, the rocker shaft 14, and the pins 22 and 25 are common between the two variable valve apparatus. The variable valve apparatus 1 of the present embodiment is illustrated by solid lines, while the variable valve apparatus of the comparative example is illustrated by broken lines.

According to the variable valve apparatus of the comparative example shown in FIG. 7, the radius of the base circle of a zero lift cam 90 is made equal to the radius R1 of the base circle of the cam 9. A roller 92 arranged concentrically with the pins 22 and 25, and a hydraulic lash adjuster 93 are provided in a second rocker arm 91 of the comparative example. When the valve 2 is closed, the roller 92 contacts the zero lift cam 90. As will be understood from FIG. 7, according to the variable valve apparatus of this comparative example, in order to avoid interference between the second rocker arm 91 and the zero lift cam 90 it is necessary to make the measurement in the height direction of the second rocker arm 91 smaller than the measurements in the height direction of the second rocker arms 4 and 5 of the present embodiment. Consequently, since the distance between a top face 94 of the second rocker arm 91 and the pins 22 and 25 narrows, it is difficult to provide the oil supply path 24 that supplies oil to the hydraulic lash adjuster 93 in that portion.

Further, because the measurement in the height direction of the second rocker arm 91 is small, and also to avoid interference with the roller 92, compared to the hydraulic lash adjuster 18 of the present embodiment, it is necessary to arrange the hydraulic lash adjuster 93 at a position which is further from the rocker shaft 14 and which is also shifted downwards.

In comparison with the variable valve apparatus of the above described comparative example, according to the variable valve apparatus 1 of the present embodiment, by making the radius R2 of the base circle of the zero lift cam 17 smaller than the radius R1 of the base circle of the cam, the hydraulic lash adjuster 18 can be brought near to the rocker shaft 14 without interfering with the zero lift cam 17. Hence, the length (distance from the center of the rocker shaft 14 to the hydraulic lash adjuster 18) of the second rocker arms 4 and 5 can be shortened. The moment of inertia is proportionate to the square of the distance from the center of rotation. Therefore, when the length of the second rocker arm increases, the moment of inertia rapidly increases. According to the variable valve apparatus 1 of the present embodiment, since the length of the second rocker arms 4 and 5 can be shortened compared to the comparative example, not only can the variable valve apparatus 1 of the present embodiment be reduced in size, but the moment of inertia can also be decreased. Thus, the equivalent inertia weight of the valve mechanism system can be reduced, and an increase in a spring load required for the valve spring 6 and the like as well as an increase in friction can be reliably suppressed.

Further, according to the variable valve apparatus 1 of the present embodiment, the measurements in the height direction of the second rocker arms 4 and 5 can be increased in comparison to the comparative example. As a result, the position of the hydraulic lash adjuster 18 can be moved upward. Consequently, when the lengths of the valves 2 are the same, the position of the camshaft 8 can be lowered. Hence, the height of the variable valve apparatus 1 can be lowered. Further, the cylinder head and cam carrier can be reduced in size, and the weights thereof can be decreased.

In addition, according to the variable valve apparatus 1 of the present embodiment, since it is possible to increase the measurements in the height direction of the second rocker arms 4 and 5, a distance between the upper face (contact surface with respect to the zero lift cam 17) of the second rocker arms 4 and 5 and the pins 22 and 25 can be made sufficiently long. Hence, the oil supply path 24 that supplies oil to the hydraulic lash adjuster 18 can be easily provided at the aforementioned portion. In particular, according to the present embodiment, by adopting a configuration such that the second rocker arms 4 and 5 contact the zero lift cam 17 directly, and not via a roller, the oil supply path 24 can be provided extremely easily since a roller is not present at a portion that the oil supply path 24 passes through.

The above described advantages of the present invention will now be described further with reference to FIG. 4. With respect to FIG. 4, if a case is assumed in which, for instance, the radius R2 of the base circle of the zero lift cam 17 is the same as the radius R1 of the base circle of the cam 9, the oil supply path 24 and the pad 19 would be provided inside a width denoted by reference character W1 in FIG. 4 in the second rocker arms 4 and 5. However, it is spatially impossible to provide both the oil supply path 24 and the pad 19 inside that narrow width W1. Further, even if the pad 19 is omitted and only the oil supply path 24 is provided, the walls will be excessively thin and the strength thereof will be insufficient and therefore it will be difficult to adopt the above scheme.

In contrast, according to the present embodiment, by making the radius R2 of the base circle of the zero lift cam 17 smaller than the radius R1 of the base circle of the cam 9, a space in which to arrange the oil supply path 24 and pad 19 can be enlarged to a width denoted by reference characters W2 in FIG. 4. As a result, the oil supply path 24 and the pad 19 can be provided with sufficient margin to avoid difficulty.

According to the present embodiment, the switching mechanism 7 is configured to displace the pin by means of the electromagnetic solenoid and a rotary force of the camshaft 8 without utilizing a hydraulic pressure. In contrast, a configuration may also be adopted in which the pin of the switching mechanism 7 is displaced by a hydraulic pressure. However, there is the following problem in such a case. In the case of supplying a hydraulic pressure to the pin of the switching mechanism 7, since it is difficult to produce a separate hydraulic pressure to the hydraulic pressure that is supplied to the hydraulic lash adjuster 18, normally both of these hydraulic pressures are the same pressure. However, the strength of a suitable hydraulic pressure for the pin of the switching mechanism 7 and the strength of a suitable hydraulic pressure for the hydraulic lash adjuster 18 are different. More specifically, a relatively high hydraulic pressure is necessary in order to displace the pin of the switching mechanism 7 against the resistance of the urging force of the coil spring 32. In contrast, if a hydraulic pressure supplied to the hydraulic lash adjuster 18 is too high, a "pump-up" action is liable to arise in which the hydraulic lash adjuster 18 expands more than required and the valve 2 does not close completely. In contrast, according to the present embodiment, since a hydraulic pressure of a suitable strength can be supplied to the hydraulic lash adjuster 18 because the switching mechanism 7 that does not utilize a hydraulic pressure is used, the occurrence of a "pump-up" action can be reliably prevented.

According to the above described embodiment a case is described in which the cam that can contact the second rocker arms 4 and 5 is the zero lift cam 17. However, the present invention is also applicable to a case where the cam that can contact the second rocker arms 4 and 5 is a cam (low lift cam) with a lift that is less than the cam 9.

In the above described embodiment, the zero lift cam 17 corresponds to a "low lift cam" of the first invention, the hollow portions of the sleeves 12, 21 and 26 correspond to a "pin insertion hole" of the first invention, and the pin pressing member 27, arm 29, guide rail 30, coil spring 32, engagement protrusion 33 and electromagnetic solenoid 34 correspond to a "pin moving mechanism" of the second invention.

Embodiment 2

Figure 8:
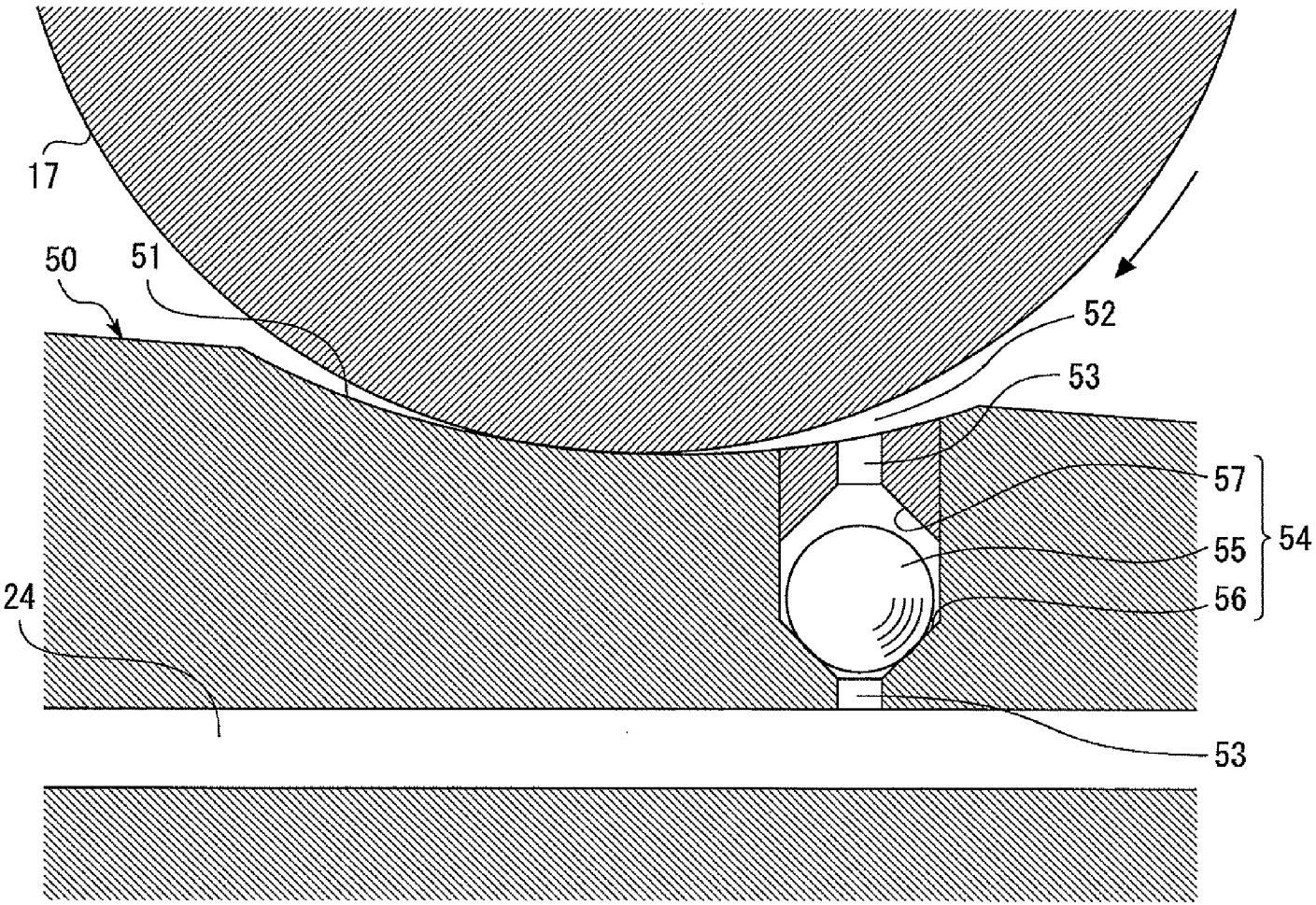
FIG. 8 is a cross-sectional view that illustrates an area in the vicinity of a contact portion between a second rocker arm and a zero lift cam of a variable valve apparatus of Embodiment 2 of the present invention in an enlarged manner.

Next, Embodiment 2 of the present invention is described referring to FIG. 8. The description of Embodiment 2 centers on the difference with respect to the above described Embodiment 1, and a description of items that are the same as in Embodiment 1 is simplified or omitted. FIG. 8 is a cross-sectional view that illustrates an area in the vicinity of a contact portion between a second rocker arm 50 and a zero lift cam 17 of a variable valve apparatus of Embodiment 2 of the present invention in an enlarged manner.

According to the present embodiment, a member corresponding to the pad 19 of Embodiment 1 is omitted, and a contact surface 51 with respect to the zero lift cam 17 is formed directly on the main body of the second rocker arm 50. The contact surface 51 is formed in the shape of a recessed curved surface (recess R shape). A curvature radius of the contact surface 51 is configured to be greater than the radius R2 of the base circle of the zero lift cam 17. As a result, a wedge-shaped gap 52 is formed between the zero lift can 17 and the contact surface 51. Lubrication between the zero lift cam 17 and the contact surface 51 can be favorably performed by oil that enters the gap 52. This effect is referred to as a "wedge oil film" effect. Sliding resistance between the zero lift cam 17 and the contact surface 51 can be reliably reduced by the wedge oil film effect.

The second rocker arm 50 of the present embodiment includes a lubricating oil supply path 53 that supplies oil in the oil supply path 24 to the contact surface 51. The lubricating oil supply path 53 opens onto the contact surface 51 and also communicates with the oil supply path 24. According to the present embodiment, since oil from the lubricating oil supply path 53 can be supplied between the zero lift cam 17 and the contact surface 51, the wedge oil film effect can be exerted more reliably.

When the second rocker arm 50 is rocking, it is not necessary to supply oil to the contact surface 51 since the contact surface 51 is separated from the zero lift cam 17. Therefore, according to the present embodiment an oil-supply stop valve 54 is provided that automatically seals off the lubricating oil supply path 53 when the second rocker arm 50 is rocking.

The oil-supply stop valve 54 has a ball 55. A bowl-shaped (recessed circular conical surface shape) inclined surface 56 is formed around an oil inlet of a chamber that contains the ball 55. Likewise, a bowl-shaped (recessed circular conical surface shape) inclined surface 57 is formed around an oil outlet of the chamber that contains the ball 55. In a state in which the second rocker arm 50 is not rocking, that is, in a state in which the valve 2 is stopped, the ball 55 is lifted up by the hydraulic pressure from the oil supply path 24 so that the ball 55 separates from the inclined surface 56. As a result, oil passes through the oil-supply stop valve 54 and is supplied to the contact surface 51.

In contrast, when the second rocker arm 50 rocks in a direction from the lower side to the upper side in FIG. 8, the ball 55 is pressed against the inclined surface 56 by the force of inertia. Consequently, the flow channel is sealed off and the supply of oil to the contact surface 51 is stopped. Further, when the second rocker aim 50 rocks in a direction from the upper side to the lower side in FIG. 8, the ball 55 is pressed against the inclined surface 57 by the force of inertia. Consequently, the flow channel is sealed off and the supply of oil to the contact surface 51 is stopped. Thus, when the second rocker arm 50 rocks and it is not necessary to supply oil to the contact surface 51, the supply of oil can be automatically stopped by the oil-supply stop valve 54. Therefore, the oil flow rate can be reduced.

Embodiment 3

Figure 9:
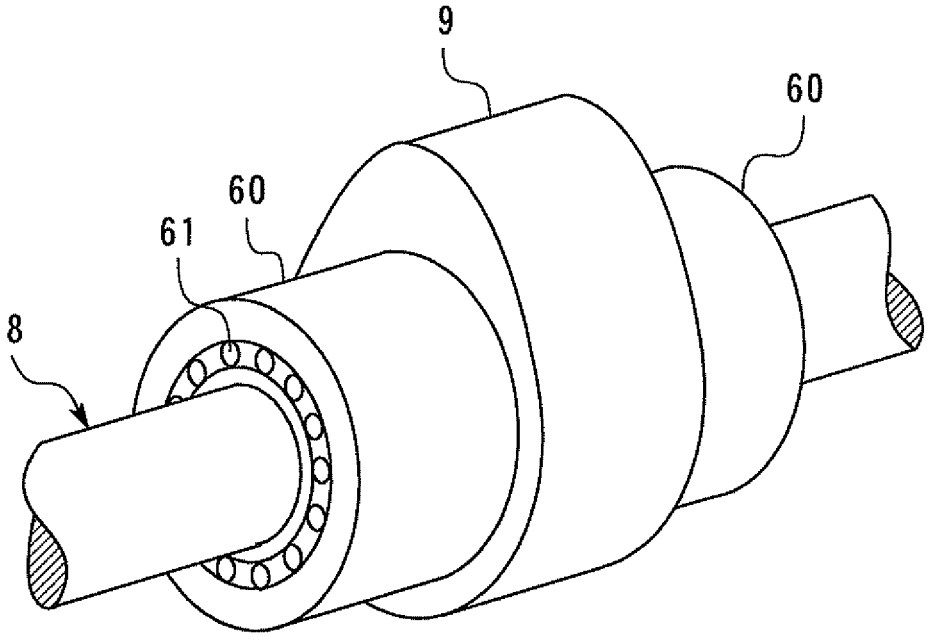
FIG. 9 is an oblique perspective view that illustrates a camshaft of a variable valve apparatus of Embodiment 3 of the present invention.

Next, Embodiment 3 of the present invention is described referring to FIG. 9. The description of Embodiment 3 centers on differences with the above described Embodiment 1, and a description of items that are the same as in Embodiment 1 is simplified or omitted. FIG. 9 is an oblique perspective view that illustrates a camshaft of a variable valve apparatus of Embodiment 3 of the present invention.

A feature of the variable valve apparatus of the present embodiment is that a zero lift cam 60 is mounted on a camshaft 8 via a rolling bearing, and the zero lift cam 60 can rotate relatively with respect to the camshaft 8. More specifically, the zero lift cam 60 is mounted so as to be capable of rotating smoothly via a needle roller 61 with respect to the camshaft 8.

According to the variable valve apparatus of the present embodiment, when operations of the valves 2 are stopped, more specifically, when the second rocker arms 4 and 5 are in contact with the zero lift cam 60, rotation of the zero lift cam 60 stops and the camshaft 8 idles with respect to the zero lift cam 60. More specifically, since the zero lift cam 60 does not slide with respect to the second rocker arms 4 and 5, friction can be sufficiently reduced.

The invention claimed is:

1. A variable valve apparatus for an internal combustion engine, comprising:

a camshaft defining a camshaft axis;

a cam having a first lift and a first base circle radius, the cam disposed on said camshaft and configured to rotate with the camshaft about the camshaft axis;

a first rocker arm includes a roller that contacts the cam, the first rocker arm is rocked by rotation of the cam;

a low lift cam that is arranged coaxially with the cam, the low lift cam has a second lift that is less than the first lift, and has a second base circle radius that is less than the first base circle radius;

a second rocker arm that is arranged next to the first rocker arm, the second rocker arm includes;

a first end, a second end spaced from the first end, a contact surface disposed between the first end and the second end that can contact the low lift cam, and a rocking center defined by the second rocker arm at the first end;

a switching mechanism that includes a plurality of pins and a plurality of pin insertion holes, wherein at least one of the pin insertion holes is formed in each of the first rocker arm and the second rocker arm and at least one of the plurality of pins is movably inserted into each of the pin insertion holes, the switching mechanism switching between a connected state and a non-connected state by moving the pins, the connected state being a state where the first rocker arm and the second rocker arm are connected to each other through the pins and the non-connected state being a state in which the connection of the first rocker arm and the second rocker arm is released;

a hydraulic lash adjuster arranged at the second end, opposite the rocking center of the second rocker arm;

a valve that opens as a result of being pressed by the second rocker arm via the hydraulic lash adjuster; and an oil supply path that is formed inside the second rocker arm and that supplies oil to the hydraulic lash adjuster;

wherein:

the second rocker arm contacts the low lift cam directly, and not via a roller; and the oil supply path passes below the contact surface of the second rocker arm with respect to the low lift cam and above the pin insertion holes formed in the second rocker arm.

2. The variable valve apparatus for an internal combustion engine according to claim 1, wherein:

the switching mechanism has a pin moving mechanism that displaces the pins between a position of the connected state and a position of the non-connected state; and the pin moving mechanism displaces the pins by means of a force other than a hydraulic pressure.

3. The variable valve apparatus for an internal combustion engine according to claim 1, wherein the pins are provided concentrically with the roller included in the first rocker arm.

4. The variable valve apparatus for an internal combustion engine according to claim 1, wherein the second rocker arm defines a lubricating oil supply path that supplies oil from the oil supply path to the contact surface, between the second rocker arm and the low lift cam; and an oil-supply stop valve that seals off the lubricating oil supply path when the second rocker arm rocks.

5. The variable valve apparatus for an internal combustion engine according to claim 1, wherein the contact surface of the second rocker arm with respect to the low lift cam is a recessed curved surface which has a curvature radius that is greater than the second base circle radius.

6. The variable valve apparatus for an internal combustion engine according to claim 1, wherein the low lift cam is mounted via a rolling bearing on the camshaft.

7. The variable valve app apparatus for an internal combustion engine according to claim 1, wherein:

the low lift cam is further defined as a pair of low lift cams, with one of the low lift cams being arranged on each side of the cam; and the second rocker arm is further defined as a pair of second rocker arms, with one of the second rocker arms being arranged on each side of the first rocker arm.

8. The variable valve apparatus for an internal combustion engine according to claim 1, wherein the oil supply path formed inside the second rocker arm is formed in a straight line shape.

9. The variable valve apparatus for an internal combustion engine according to claim 1, wherein the second rocker arm further includes a pad, and the second rocker arm contacts the low lift cam directly with the pad.

* * * * *